US010786079B2

(12) United States Patent
Rihtarec et al.

(10) Patent No.: US 10,786,079 B2
(45) Date of Patent: Sep. 29, 2020

(54) GUIDANCE SYSTEM

(71) Applicant: Grass GmbH, Hoechst (AT)

(72) Inventors: Filip Rihtarec, Fussach (AT); Juergen Nachbaur, Hohenems (AT); Manfred Roeder, Lonsee (DE)

(73) Assignee: Grass GmbH, Hoechst (AT)

( * ) Notice: Subject to any disclaimer, the term of this patent is extended or adjusted under 35 U.S.C. 154(b) by 15 days.

(21) Appl. No.: 16/207,667

(22) Filed: Dec. 3, 2018

(65) Prior Publication Data

US 2019/0166998 A1 Jun. 6, 2019

(30) Foreign Application Priority Data

Dec. 4, 2017 (DE) ..... 10 2017 128 748

(51) Int. Cl.

| | |
|---|---|
| ***A47B 88/437*** | (2017.01) |
| ***A47B 88/433*** | (2017.01) |
| ***A47B 88/407*** | (2017.01) |
| ***A47B 88/493*** | (2017.01) |
| ***A47B 88/477*** | (2017.01) |
| *A47B 88/463* | (2017.01) |
| *A47B 88/467* | (2017.01) |

(52) U.S. Cl.

CPC ..... *A47B 88/437* (2017.01); *A47B 88/407* (2017.01); *A47B 88/433* (2017.01); *A47B 88/477* (2017.01); *A47B 88/493* (2017.01); *A47B 88/463* (2017.01); *A47B 88/467* (2017.01)

(58) Field of Classification Search

CPC ..... A47B 88/40; A47B 88/407; A47B 88/433; A47B 88/437; A47B 88/477; A47B 88/493

USPC ..... 312/330.1, 334.1, 334.6, 334.8, 334.9, 312/334.12, 334.13

See application file for complete search history.

(56) References Cited

U.S. PATENT DOCUMENTS 2,505,592 A * 4/1950 Stone ..... A47B 88/437 384/59
2,525,971 A * 10/1950 Stone ..... A47B 88/437 384/59

(Continued)

FOREIGN PATENT DOCUMENTS

| | | |
|---|---|---|
| DE | 39 21 858 A1 | 1/1991 |
| DE | 94 10 689 U1 | 1/1995 |
| DE | 20 2010 009 163 U1 | 2/2012 |

OTHER PUBLICATIONS

German Search Report (Application No. 10 2017 128 748.5) dated Oct. 15, 2018.

*Primary Examiner* — James O Hansen
(74) *Attorney, Agent, or Firm* — Burr & Brown, PLLC

(57) ABSTRACT

A guidance system including a guide rail and a sliding element rail, and designed to movably connect a linearly movable sliding element to a body. A carriage is arranged between the rails so that the sliding element rail is movable relative to the guide rail. The guide rail includes a running surface on a top side and/or on a bottom side. A movement element of the carriage is movably guided on the running surface. The top side of the guide rail is provided opposite to and spaced apart from the bottom side of the guide rail. The guide rail has a recess on the top side and/or on the bottom side in an end segment of the guide rail, through which a bearing body protrudes, and attachment means are provided in the area of the recess in order to mount the bearing body.

15 Claims, 6 Drawing Sheets

(56) References Cited

U.S. PATENT DOCUMENTS

| | | | | |
|---|---|---|---|---|
| 2012/0049712 | A1* | 3/2012 | Lobbezoo | F16C 29/045 312/334.12 |
| 2013/0076221 | A1* | 3/2013 | Hammerle | F16C 33/34 312/334.1 |
| 2015/0230604 | A1* | 8/2015 | Violand | A47B 88/57 312/334.12 |
| 2015/0257536 | A1* | 9/2015 | Chen | A47B 88/493 384/18 |
| 2016/0242545 | A1* | 8/2016 | Violand | F16C 29/005 |

* cited by examiner

GUIDANCE SYSTEM

This application claims the benefit under 35 USC § 119(a)-(d) of German Application No. 10 2017 128 748.5 filed Dec. 4, 2017, the entirety of which is incorporated herein by reference.

FIELD OF THE INVENTION

The present invention relates to a guidance system to movably connect a linearly movable sliding element to a body comprising a guide rail and sliding element rail.

BACKGROUND OF THE INVENTION

A guidance system, especially for a sliding element, such as for a sliding element of furniture or a household or kitchen appliance, is known in various designs.

For example, so-called partial extensions or full extensions with mutually telescopically movable guide rails are in use as guidance systems. These guide rails are mounted movable to each other by means of carriages.

Generally a sliding element such as a drawer, a shelf, a cooking product carrier or the like is movably received by precisely two separate but identical structural units of a partial extension or a full extension. The mounting is done preferably secured on inner sides of a furniture body or a housing, such as a body, of a household or kitchen appliance.

Since a guidance system must stand up to high technical and economical demands, further optimizations in this regard are necessary for the existing solutions.

The problem which the present invention proposes to solve is to further improve the aforementioned guidance system, especially in terms of a relatively high mechanical loading capacity with economical manufacture at the same time.

SUMMARY OF THE INVENTION

In particular, material-saving and highly stable guides should be provided, withstanding, in particular, high static and dynamic loads and being advantageous in their design, and furthermore space-saving in their use.

The present invention starts from a guidance system, especially a linear guidance system, wherein the guidance system comprises a guide rail and a sliding element rail, wherein the guidance system is designed to movably connect a linearly movable sliding element, such as a drawer, to a body, wherein a carriage can be arranged between the guide rail and the sliding element rail so that the sliding element rail in the mounted condition of the guidance system is movable relative to the guide rail.

The guidance system is advantageously designed as a furniture guidance system or as a household appliance guidance system, especially in the form of a subfloor guidance system. A subfloor guidance system can advantageously be mounted on a bottom side of a bottom of the sliding element. Yet, it is also conceivable for the guidance system to be mounted on, in particular in, a frame, such as inside a hollow chamber frame. The rail guidance system formed with the guide rail is designed, in particular, as linear guides.

The guidance system is preferably present as a full extension and it comprises, besides the guide rail and the sliding element rail, a body rail, wherein the guide rail in this case is configured as a center rail. It is also conceivable for the guidance system to be configured as a partial extension.

As a partial extension, the guidance system comprises the guide rail and the sliding element rail, in this case the guide rail being configured as the body rail. Usually a carriage is present with a movement element in the form of a plain and/or roller bearing means for the displaceable relative movement of the rails.

Advantageously, the sliding element rail in the mounted condition on the movable sliding element is connected to the sliding element, especially in firm manner. For example, the guide rail in the case of a partial extension, such as the body rail in the mounted condition on the body, is connected to the body, especially in firm manner.

The crux of the present invention lies in the fact that the guide rail comprises a running surface, especially a flat running surface, on a top side and/or on a bottom side, wherein a movement element of the carriage is movably guided on the running surface in the mounted condition of the guidance system, wherein the top side of the guide rail is provided opposite to and spaced apart from the bottom side of the guide rail, wherein the guide rail has a recess on the top side and/or on the bottom side in an end segment of the guide rail, through which a bearing body protrudes, and attachment means are provided in the area of the recess in order to mount the bearing body, so that in the closed condition of the guidance system the sliding element rail is braced against the guide rail. This prevents a change in the joint pattern of the furniture on which the guidance system can be mounted, especially depending on a weight of the sliding element, such as the drawer. The term bottom side of the guide rail refers to an orientation of the guide rail in the condition of use or the condition of installation of the guidance system on a furniture piece or on a household appliance. The closed condition of the guidance system, especially the fully closed condition of the guidance system, is advantageously dictated by end stops of the guidance system. The opened condition of the guidance system, especially the fully opened condition of the guidance system, is preferably dictated by further end stops of the guidance system. The end stops are formed, for example, on the guide rail and/or on the sliding element rail.

Advantageously, the closed condition of the guidance system is configured such that, e.g., in the mounted condition of the guidance system on a piece of furniture, a movable part of the piece of furniture in a closed condition of the guidance system is situated relative to a furniture body of the piece of furniture in a closed position, especially a fully closed position, such as a moved up position.

Advantageously, a single bearing body is present. It is also conceivable to have several, especially two or three bearing bodies. For example, two or more bearing bodies are arranged next to each other. For example, one bearing body comprises a bearing shaft and the bearing shafts of two bearing bodies are oriented parallel to each other; in particular, the axes of rotation of the bearing shafts are coincidental.

Advantageously, the guide rail comprises the recess in a forward end segment. The forward end segment of the guide rail is situated in the mounted condition of the guidance system in the region of a body opening or in the region of a sliding element front. The forward end segment of the guide rail forms, e.g., a front quarter, a front sixth, a front eighth or a front tenth of the guide rail looking in the lengthwise extension of the guide rail. The running surface extends preferably for more than half, e.g., for more than two thirds of a length of a lengthwise extension of the guide rail.

The guide rail, for example, is present in mirror symmetry in a cross section, the cross section being seen transversely to a longitudinal axis of the guide rail.

Advantageously, the attachment means comprise a recess, especially a cutout on the top side and/or the bottom side of the guide rail. The recess is for example a perforation or an opening at the top side and/or bottom side. The recess is provided, for example, as a rectangular or square opening.

It also proves to be of advantage for the attachment means to comprise a holding member for mounting the bearing body movably on the guide rail. The bearing body for example can be clipped or clamped to the holding member. The holding member is fashioned for example as a recess, in which an axis of rotation of the bearing body can be movably mounted, for example.

It is further proposed that the holding member is designed to mount the bearing body directly on the guide rail. In this way, the guide rail can be relatively economically produced. For example, the holding member is configured on the guide rail. Advantageously, the holding member is part of the guide rail, e.g., it is provided as a single part or single piece with the guide rail. In particular, the holding member is integrated in the guide rail.

It also proves to be of advantage for the guidance system to be designed as a full extension and to comprise, besides the guide rail and the sliding element rail, a body rail, while in the mounted condition of the guidance system the guide rail is present between the body rail and the sliding element rail, wherein the bearing body is mounted, in particular, movably on holding means of the top side of the guide rail in order to brace the guide rail against the body rail in the closed condition of the guidance system. In the mounted condition of the guidance system, a top side of the body rail is present opposite and spaced apart from the bottom side of the guide rail, for example, from the bottom side of the center rail. Also in the mounted condition of the guidance system a top side of the guide rail, such as a top side of the center rail, is arranged opposite and spaced apart from the bottom side of the sliding element rail.

In one advantageous embodiment of the guidance system, the attachment means comprise an attachment member in order to attach the bearing body to, for example mount the bearing body on, the guide rail, especially at the recess. This makes it relatively easier to manufacture and/or install the guidance system. The attachment member is preferably a component fashioned separately from the guide rail. The attachment member is present, for example, as a roller holder. Advantageously, the attachment member can be fastened or secured on the guide rail, especially at the recess. For example, the attachment member in the mounted condition of the guidance system is fastened or secured to the guide rail. For example, the attachment member can be secured on the holding member.

It is further of advantage for the bearing body to be movably mounted on the attachment member.

Furthermore, it is proposed that the attachment member has a U-shape, e.g., in a cross section. Advantageously, the attachment member is provided as a sheet metal bent piece or as a stamped piece. For example, the attachment member comprises two side walls and a bottom side, wherein the bottom side is provided perpendicular to the side walls and the side walls are provided at a spacing from each other. Advantageously, the bearing body can be mounted between the side walls, e.g., on the side walls, on the attachment member. Advantageously, the bearing body can be mounted on the attachment member such that a movement direction, especially a direction of rotation, of a bearing wheel of the bearing body is oriented parallel to a side surface of a side wall of the attachment member, the attachment member at least partly enclosing the bearing body with the side surface.

The ends of the side surfaces of the attachment member facing away from the bottom side of the attachment member are bent or folded, e.g., especially in L shape or in gooseneck manner, for example. The bent ends of the side surface of the attachment member advantageously lie on or against the top side and/or the bottom side of the guide rail in the mounted condition of the attachment member on the guide rail. The bent ends of the attachment member are provided engaging with the top side and/or the bottom side of the guide rail, for example.

Advantageously, the attachment member is firm with the guide rail, e.g., firm in position, especially permanently connected, in the mounted condition on the guide rail. For example, the attachment member is clamped and/or joined in the mounted condition on the guide rail, such as riveted, welded, and/or glued.

Furthermore, it is of advantage for the guidance system to be designed, in particular, for the recess to be arranged on the guide rail, such that the bearing body is freely movable on the guide rail in an opened condition of the guidance system. For example, the bearing wheel has no resistance in the freely movable condition of the bearing body, except for the natural frictional resistance due to the mounting on the bearing shaft of the bearing body, for example. Advantageously, the guidance system is designed such that the sliding element rail and/or the body rail is not in contact with or touching the bearing body in the opened condition of the guidance system.

Furthermore, it proves to be of advantage for the guide rail to comprise a cavity, wherein the cavity extends along the longitudinal axis of the guide rail, and the top side and/or the bottom side of the guide rail form boundary surfaces of the cavity.

Advantageously, the guide rail comprises an especially continuous, e.g., a single cavity along a lengthwise extension, wherein the cavity is bounded, for example, by the top side and/or the bottom side of the guide rail. Preferably, the cavity extends along the longitudinal axis of the guide rail for the entire length of the guide rail. For example, the cavity is enclosed circumferentially by boundary surfaces of the guide rail, in particular entirely so enclosed, in a cross section of the guide rail, looking perpendicular to the longitudinal axis of the guide rail.

Advantageously, a portion of the bearing body is present in the cavity in the mounted condition of the guidance system. For example, the bearing body protrudes into the cavity of the guide rail. For example, 50% of the bearing body, such as more than 50%, e.g. 75%, especially more than 75% of the bearing body in the mounted condition on the guide rail protrudes into the cavity of the guide rail. Preferably, the guide rail and especially the cavity possesses a triangular, hourglass and/or butterfly contour in a cross section, especially looking in the lengthwise direction.

In one advantageous modification of the guidance system, the attachment member is configured such that the bearing body can be clipped and/or clamped on the attachment member. For example, the bearing body can be pushed onto the attachment member. For example, a bearing shaft of the bearing body can be mounted on the attachment member, e.g., by clamping, especially in rotationally firm manner. Advantageously, the bearing body comprises a bearing wheel or a bearing roller and the bearing shaft, while the bearing wheel is mounted e.g. rotatably on the bearing shaft. It is also conceivable for the bearing wheel to be connected in rotationally firm manner to the bearing shaft. If the bearing wheel is coupled rotationally firmly to the bearing shaft, the bearing shaft is advantageously mounted movably on the attachment member in the mounted condition.

It likewise proves to be advantageous for the sliding element rail to comprise a running surface on one bottom side, while an elevation is present on one segment, especially in a forward region, of the bottom side of the sliding element rail, on which the bearing body travels in a movement of the guide rail of the guidance system in the closing direction, i.e., in the direction of the closed condition of the guidance system, so that the sliding element rail is braced by the bearing body against the guide rail. This prevents a tilting of the sliding element, e.g., due to a comparatively heavy weight of the sliding element with contents, for example, in the closed condition of the sliding element on the body.

It is also conceivable for a top side of the body rail to have a running surface, while an elevation is present on a front region of the top side of the body rail, on which the bearing body travels in a movement of the rail of the guidance system in the closing direction, in the direction of the closed condition, so that the guide rail is braced by the bearing body against the body rail.

The elevation is advantageously provided protruding with respect to the bottom side and/or the running surface of the bottom side of the sliding element rail or protruding with respect to the top side and/or the running surface of the top side of the body rail. The elevation is configured, for example, as a bending out or punched out feature. For example, the elevation is integrated with the sliding element rail and/or with the body rail.

Furthermore, it is advantageous for the elevation to be provided rising on the sliding element rail and/or on the body rail. For example, the elevation is provided rising such that the bearing body of the guide rail comes in contact with the elevation of the sliding element rail and/or with the elevation of the body rail in a closing movement of the sliding element rail relative to the guide rail and/or in a closing movement of the body rail relative to the guide rail and touches the elevation at least in an end movement region of the sliding element rail and/or in an end movement region of the body rail, so that the sliding element rail and/or the body rail is braced against the guide rail by the elevation and the running wheel. In particular, the elevation is fashioned as a slant. For example, the elevation is provided as a sloped surface.

It is also of advantage for the elevation to comprise an up ramp on the bottom side of the sliding element rail and/or on the top side of the body rail, looking in a movement direction of the sliding element rail and/or in a movement direction of the body rail, such as the sloping surface, and for the elevation to comprise a down ramp on the bottom side of the sliding element rail and/or on the top side of the body rail, looking in a movement direction of the sliding element rail and/or in a movement direction of the body rail, wherein the bearing body can roll along the up ramp and/or the down ramp in an opening and/or closing movement of the guide rails. Thanks to such a configuration of the elevation on the sliding element rail and/or on the body rail and the mounting of the bearing body on the center or body rail, an automatic retraction device is assisted in particular. Advantageously, the bearing body in the closed condition of the guidance system, especially in the closed condition of the sliding element rail and/or in the closed condition of the body rail relative to the guide rail is not in contact with the sliding element rail and/or not in contact with the body rail, in particular, not in contact with the elevation of the sliding element rail and/or with the elevation of the body rail. Preferably, the bearing body in the closed condition of the guidance system, especially in the closed condition of the sliding element rail relative to the guide rail, does not support the sliding element rail and/or the body rail. In the closed condition of the guidance system, the bearing body, especially an axis of rotation of the bearing body, is at a distance from the elevation, especially the down ramp, by e.g. 40 mm, such as 30 m, such as 20 mm, looking in the movement direction or lengthwise extension of the guide rails.

In particular, the elevation is present in the form of a ramp. The up ramp advantageously has a lesser gradient than the down ramp. The gradients are present as angles between a running surface of the elevation, especially a running surface of the up ramp or a running surface of the down ramp and the running surface sliding element rail. Advantageously, a bearing surface of the bearing body rolls along the running surface of the up ramp or the down ramp during a movement of the sliding element rail relative to the guide rail.

It is further of advantage for the elevation on the sliding element rail to be present in a middle region of the bottom side of the sliding element rail, looking transversely, especially perpendicularly, to a longitudinal extension of the sliding element rail. Advantageously, the elevation on the body rail is present in a middle region of the top side of the body rail, looking perpendicularly to a longitudinal extension of the body rail.

It is likewise of advantage for the recess and/or the bearing body to be provided on the guide rail and/or the elevation to be provided on the sliding element rail and/or the elevation to be provided on the body rail such that the sliding element rail and/or the body rail is braced by the bearing body against the guide rail for a movement path of around 50 mm, especially between 30 mm and 100 mm, in an opening and/or closing movement.

The elevation extends in the lengthwise extension of the sliding element rail and/or in the lengthwise extension of the body rail, for example, between 3% and 20% of an overall length of the sliding element rail and/or an overall length of the body rail, e.g., between 7% and 15%. The elevation extends in the lengthwise extension of the sliding element rail and/or in the lengthwise extension of the body rail, for example, for 3%, 4%, 5%, 6%, 7%, 8%, 9%, 10%, 11%, 12%, 13%, 14%, 15%, 16%, 17%, 18%, 19% or 20%, especially for 10.5% of an overall length of the sliding element rail and/or an overall length of the body rail.

The present invention also includes a piece of furniture or a household appliance, especially a kitchen appliance, comprising a body and a sliding element, wherein the sliding element is movably received on the body with a guidance system, wherein a guidance system according to the present invention is present for the sliding element according to one of the above discussed embodiments. In this way, the explained benefits can be accomplished for the piece of furniture or the household appliance.

BRIEF DESCRIPTION OF THE DRAWINGS

Further features and benefits of the present invention are explained more closely with the aid of the exemplary embodiments of the present invention as represented in the figures.

DETAILED DESCRIPTION OF THE INVENTION

In part, the same reference numbers are used below for corresponding elements of different exemplary embodiments.

Figure 1:
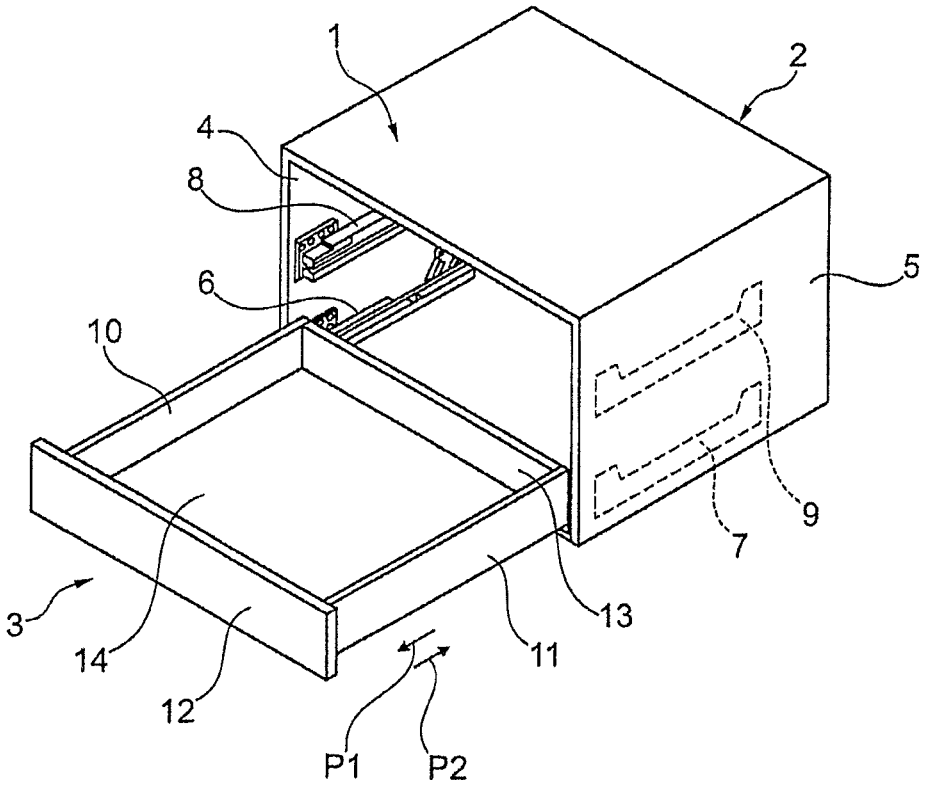
FIG. 1 is a schematically represented piece of furniture according to the present invention in perspective view slanting from above with a drawer displaceably received on it.

FIG. 1 shows highly schematized a piece of furniture 1 according to the present invention in a condition of use with a hollow cuboidal furniture body 2 and a sliding element fashioned as a drawer 3, wherein the drawer 3 is received displaceably on the furniture body 2. The furniture body 2 comprises two opposite vertical side walls 4 and 5, between which the drawer 3 can be pulled out in the horizontal direction from the furniture body 2 per P1 from a condition accommodated in the interior of the furniture body 2 via a guidance system according to the present invention with telescoping guiding means, e.g. in a subfloor design, or a first rail full extension 6 and a second rail full extension 7, and can be pushed into the body in the opposite direction per P2. In FIG. 1, the drawer 3 is shown in the condition moved out to the utmost or entirely from the interior of the furniture body 2. Hence, the storage volume of the drawer 3 is accessible from above with almost no hindrance.

If the drawer 3 uses in each case a rail partial extension instead of the rail full extension 6, 7, the drawer 3 in the maximum pulled-out condition cannot be moved so far out from the interior of the furniture body 2 in the direction P1, as is possible with the rail full extension 6, 7 per the representation in FIG. 1. The front element 12 is then closer to the open front side of the furniture body 2 than is shown in the drawer 3 of FIG. 1.

The rail full extension 6 fastened to the side wall 4 on the inside is located opposite at the same vertical height as the rail full extension 7 fastened to the side wall 5 and hidden from view in FIG. 1, being indicated by broken lines.

A further drawer correspondingly guided by rail full extensions 8 and 9 can be accommodated in the furniture body 2 above the drawer 3, not being shown in FIG. 1.

The drawer 3 comprises oppositely situated drawer side walls 10, 11, each comprising, for example, a constructed hollow chamber frame. Furthermore, the drawer 3 comprises a front element 12, a rear wall 13 situated opposite to it in the horizontal direction, and a horizontally extending drawer bottom 14, which reaches as far as the drawer side walls 10, 11, the front element 12 and the rear wall 13 or is joined to them.

Figure 2:
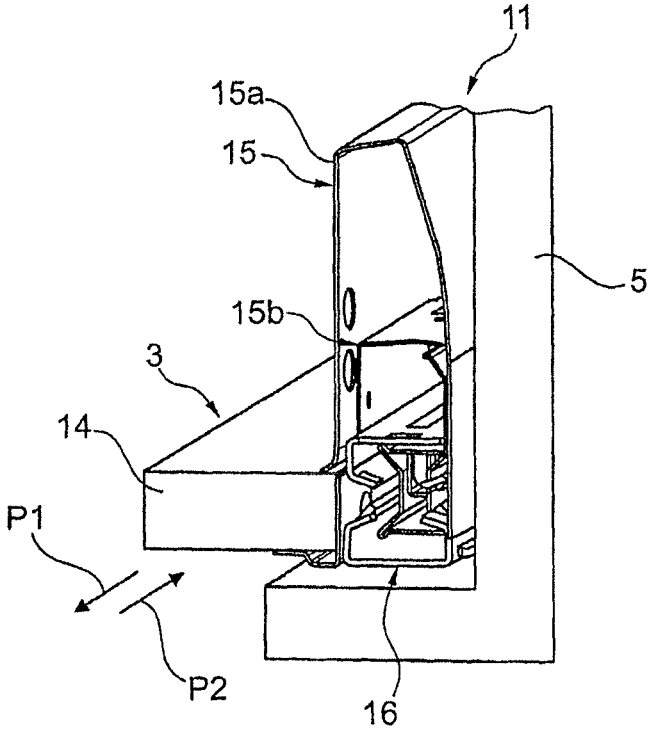
FIG. 2 is a cross section, a perspective cutout view of a piece of furniture according to the present invention in the region of a drawer side, adjacent to a furniture body wall and a furniture body bottom.
Figure 3:
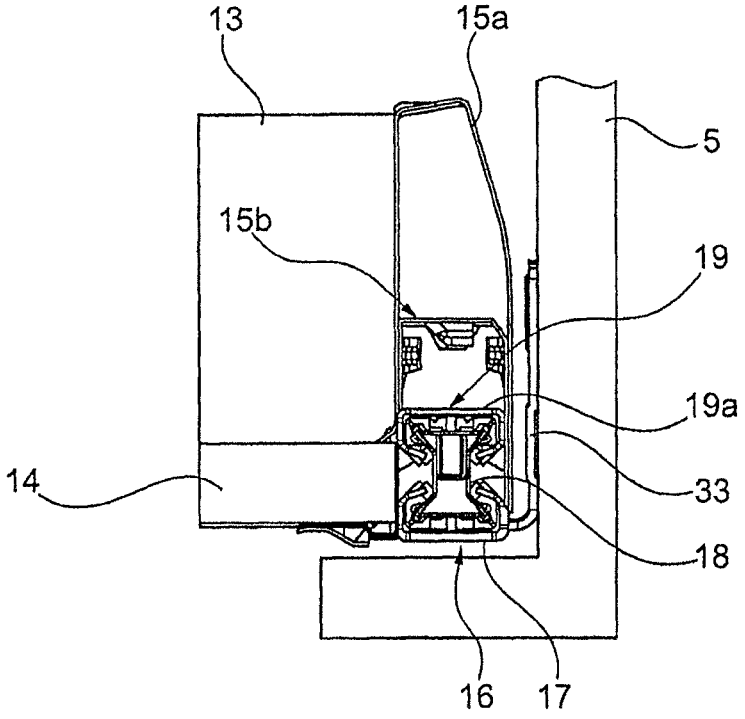
FIG. 3 is a cutout of FIG. 2 in a front view.
Figure 4:
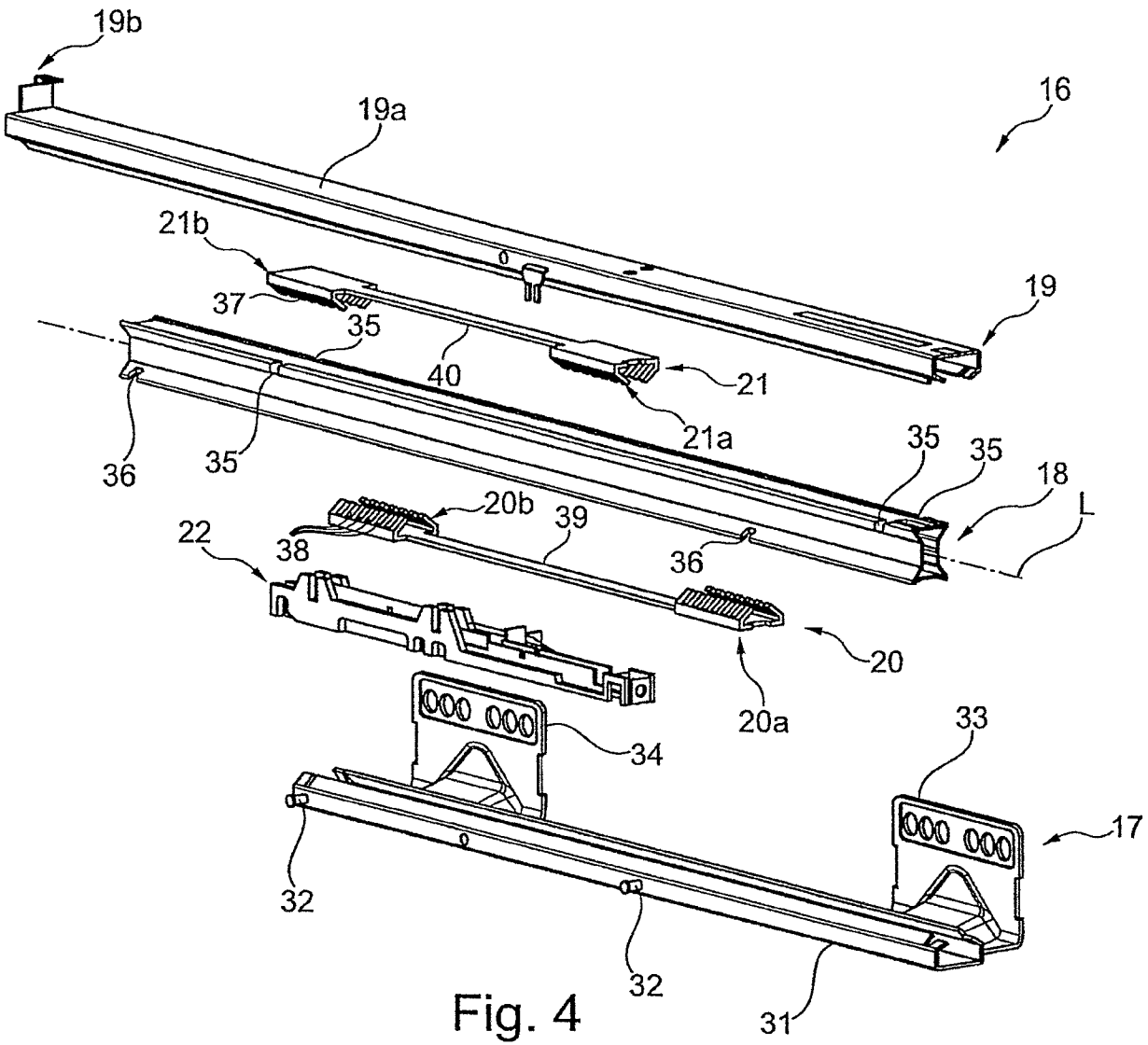
FIG. 4 is an exploded view of a structural unit of a guidance system according to the present invention.
Figure 5:
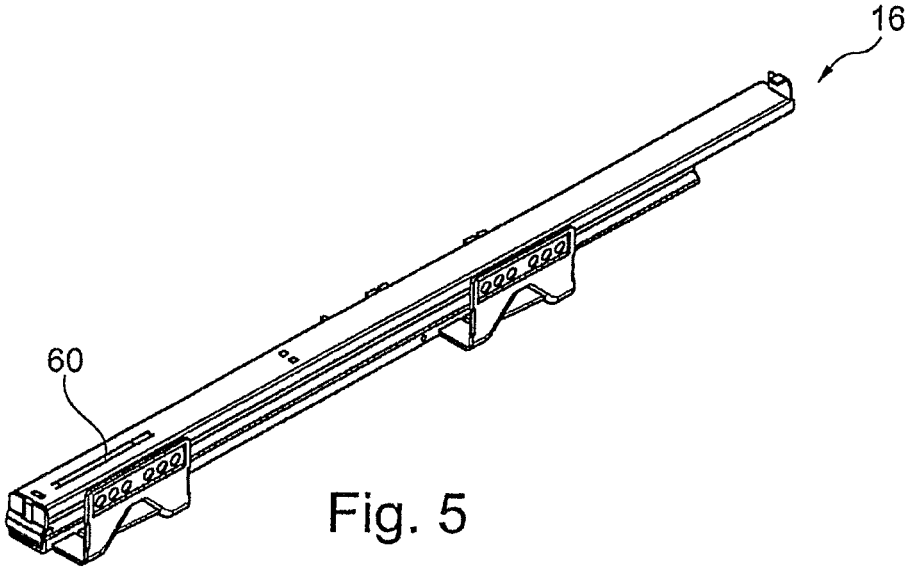
FIG. 5 is the guidance system of FIG. 4 in a perspective representation in the assembled condition.

FIGS. 2 and 3 show, in the area of a body side wall 5, a cut-out of a drawer 3, which in this embodiment comprises hollow chamber frames, with a drawer bottom 14 and a drawer side wall 11 and a rear wall 13 configured as a hollow chamber frame 15. The drawer 3 is received by two structural units of a guidance system according to the present invention on the furniture body 2 or by a rail full extension 16 according to the present invention on the side wall 5 and in the same manner by a further hollow chamber frame of the drawer 3 on the side wall 4 not visible in FIG. 2. It is received on the side wall 4 by a further structural unit or a further full extension according to the present invention, by which the drawer 3 can move in linear horizontal manner in the directions P1 and P2.

The hollow chamber frame 15 made preferably from a bent sheet metal material has an external housing 15*a* and an internal structure 15*b*, so that the full extension 16 can be recessed into the internal volume of the hollow chamber frame 15. At an inner side of the hollow chamber frame 15, it is configured to receive a lengthwise edge of the drawer bottom 14 in its lower segment.

The full extension 16 formed as a structural unit of the guidance system comprises three mutually telescopic guide rails or a body rail 17, a center rail 18 and a sliding element rail 19.

The center rail 18 is configured as a hollow profile.

A movable sliding element such as the drawer 3 is coupled or connected to the sliding element rail 19, for example, it is secured to the hollow chamber frame 15, whereas the body rail 17 is connected to the stationary part of the furniture. If the full extension 16 is being used as a subfloor guide, a bottom side of a sliding element or its bottom will be braced against a top side 19*a* of the sliding element rail 19. A hook element 19*b* protruding upward at the rear end of the sliding element rail 19 forms an end stop for a segment of a rear outer side of the sliding element, and for the exact positioning an angled segment of the hook element 19*b* parallel to the top side 19*a* engages with a suitably provided recess in the rear outer side of the sliding element. Furthermore, the sliding element rail 19 comprises end stops 61 on the top side 19*a*, which are provided as punched out features, for example, so that they are elevated with respect to a bottom side 19*c* of the sliding element rail 19 and form a movement limit for the carriage 21 in the mounted condition of the full extension 16.

Furthermore, the full extension 16 comprises a first or lower carriage 20 with bearing bodies 38 arranged on it, the carriage 20 acting between the body rail 17 and the center rail 18 for a load-transmitting relative movement of the rails 17, 18.

Moreover, the full extension 16 comprises a second or upper carriage 21 with bearing bodies 37 arranged on it, the carriage 21 acting between the center rail 18 and the sliding element rail 19 for a load-transmitting relative movement of the rails 18, 19.

The carriages 20 and 21 comprise, for example, two running cages 20*a*, 20*b* or 21*a*, 21*b* and a connection element 39 or 40.

Pins 32 are present on a vertically positioned, inwardly pointing narrow side of a rail body 31 of the body rail 17, by which a movement mechanism 22 of the full extension 16 can be attached, for example, for the ejecting and/or retracting of the drawer 3.

The body rail 17 includes two L-shaped fastening elements 33 and 34, the fastening elements 33 and 34 serving for the fastening or securing of the full extension to an inner side of the side wall of a body, such as the side wall 5 of the furniture body 2 of the furniture 1.

The guide rails 17, 18, 19 preferably consist of a sheet metal material, which is formed into the end product of the respective guide rail from the flat sheet metal material, for example, by a stamping and bending process.

Figure 6:
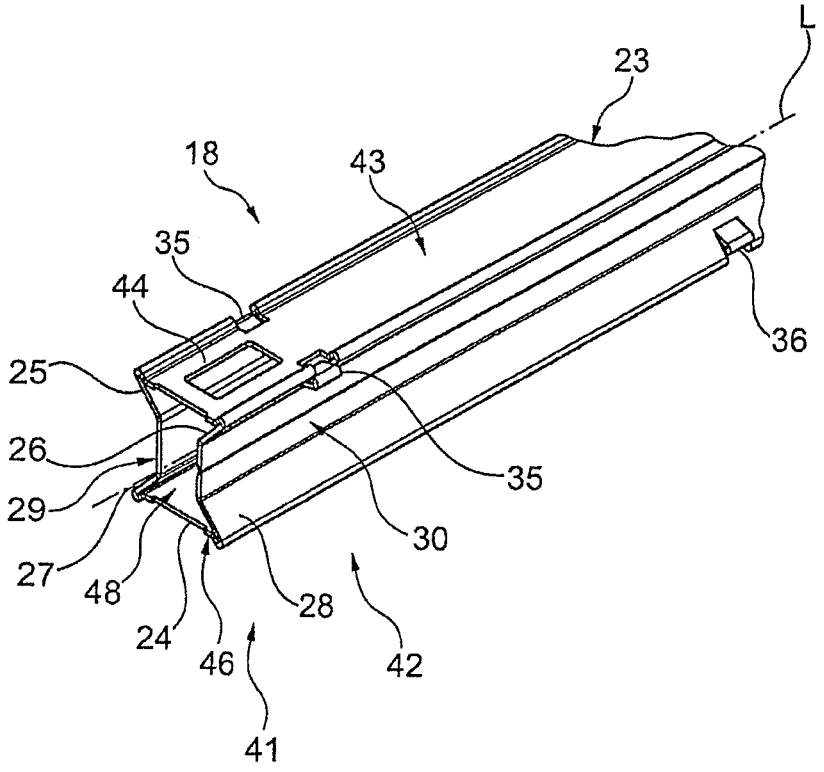
FIG. 6 is a perspective representation of the front end segment of a center rail of the guidance system without the bearing body in place.
Figure 7:
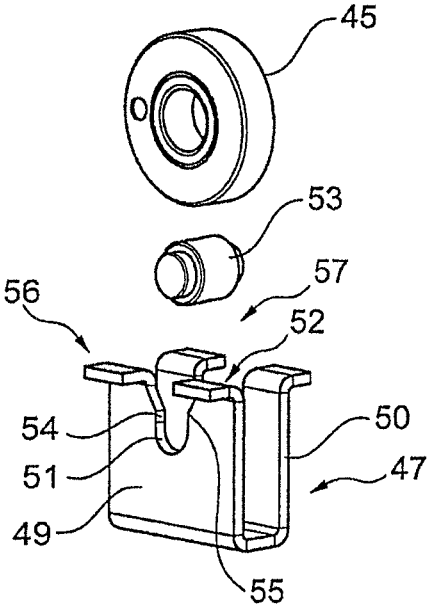
FIG. 7 is a perspective representation of a holding member according to the present invention with a bearing body and bearing shaft.

FIG. 6 shows the front end segment 41 of the center rail 18 with respect to the condition of use of the full extension 16. The center rail 18 according to the exemplary embodiment shown comprises an upper flat horizontal wall section 23, a lower flat horizontal wall section 24, two flat upper side wall sections 25, 26, two lower flat side wall sections 27, 28 and intermediate wall sections 29 and 30. The wall sections 23-30 of the center rail advantageously enclose a cavity 48, which extends in the longitudinal extension L of the center rail 18, in particular entirely in that extension.

The horizontal wall section 23 forms a distal wall or top side of the center rail 18 or the corresponding hollow profile. Accordingly, the horizontal wall section 24 forms a distal wall or bottom side of the center rail 18 or the hollow profile.

The terms upper and lower pertain to the orientation of the full extension 16 in the condition of use or in the condition mounted on the furniture, especially as shown in FIGS. 2 and 3. The planes respectively subtended by the mutually parallel horizontal wall sections 23 and 24 and their exterior or distal sides are in this case at least almost horizontally oriented.

In order to limit a relative movement of the lower carriage 20 and the upper carriage 21 with respect to the center rail 18 in the lengthwise extension of the center rail 18 along a central longitudinal axis L (see FIG. 6), upper end stops 35 and lower end stops 36 are provided on the center rail 18.

In the assembled full extension 16, the bearing bodies received on the carriages 20, 21 run on the outwardly directed sides of the center rail 18 or on the horizontal wall sections 23, 24 and the side wall sections 25-28. The lower carriage 20 engages by its segments 20*a* and 20*b* carrying the bearing bodies on the outside of the horizontal wall section 24 and the side wall sections 27, 28.

The upper carriage 21 engages by its segments 21*a* and 21*b* carrying the bearing bodies on the outside of the horizontal wall section 23 and the side wall sections 25, 26. Advantageously, the lower carriage 20 moves along a running surface 42 of the lower horizontal wall section 24 of the center rail 18 and the upper carriage 21 moves along a running surface 43 of the upper horizontal wall section 23 of the center rail 18.

The especially horizontal running surfaces 42, 43 of the center rail 18 extend advantageously between end stops 35 and 36, looking in the longitudinal extension of the center rail 18.

At the front end segment 41 of the center rail 18 there are provided attachment means in the form of a recess 44, at which a bearing body can be arranged, e.g., one in the form of a running wheel 45. The recess 44 is present, for example, as a rectangular opening on the upper horizontal wall section 23 of the center rail 18. Advantageously, the recess 44 is present, looking in the lengthwise extension L of the center rail 18, between a front end 46 of the center rail 18 and an end stop 35, the end stop 35 forming a movement boundary for the carriage 21. This ensures that the carriage 21 does not reach or go beyond the recess 44 during a relative movement of elements of the full extension 16 or that it is at a distance from the recess 44 in every position of the full extension 16. The same holds for the running surface 42 of the lower horizontal section 24.

Figure 8:
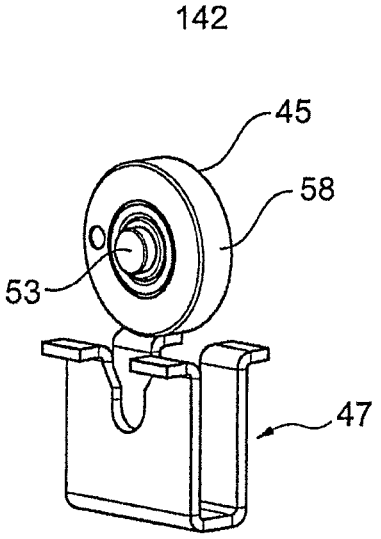
FIG. 8 is a perspective representation per FIG. 7, wherein the bearing body is mounted on the bearing shaft.
Figure 9:
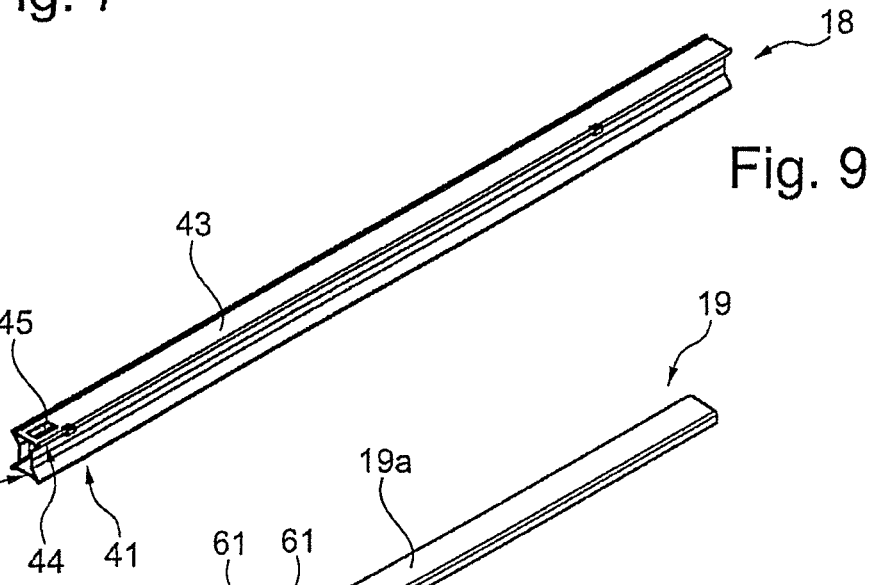
FIG. 9 is a perspective representation of a center rail of the guidance system with bearing body in place.
Figure 10:
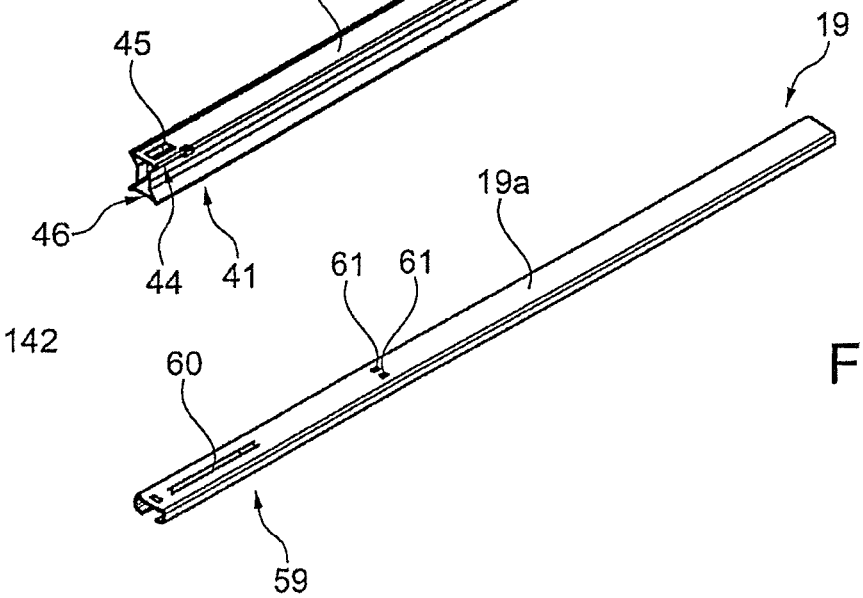
FIG. 10 is a perspective representation of a sliding element rail of the guidance system.

Advantageously, an attachment member in the form of a U-shaped stirrup 47 can be mounted at the recess 44. The stirrup 47 is bent from a metal plate, for example. On side walls 49, 50 of the stirrup 47 there are holding members 51, 52 in the form of a cutout, in order to secure a bearing shaft 53 of the running wheel 45. For example, in a first installation step the running wheel 45 is connected to the bearing shaft 53 (FIG. 8) and in a further installation step the bearing shaft 53 with the running wheel 45 is clipped or clamped onto the holding members 51, 52 in a movement from above. For example, narrow sides 54, 55 of the cutout of the holding member 51 or 52 have a spacing from each other which is less than a minimum diameter of the bearing shaft 53 in the bearing region on the holding member 51 or 52. In this way, the running wheel 45 is prevented from falling out in the mounted condition on the stirrup 47.

Figure 11:
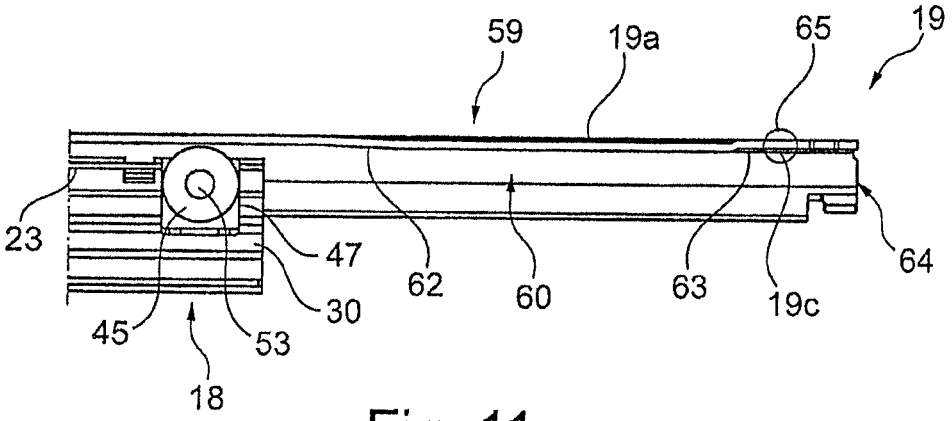
FIG. 11 is a side cross-sectional view through a sliding element rail and a body rail along a longitudinal axis of the rails in the mounted condition in an opened position of the sliding element rail relative to the body rail.

At open ends 56, 57, the side walls 49, 50 of the stirrup 47 are advantageously bent over, so that the stirrup 47 can be inserted in a direction from above into the recess 44 of the center rail 18, the stirrup 47 coming to bear by the bent-over ends of the side walls 49, 50 against the upper horizontal wall section 23. Advantageously, the side walls 49, 50 are slightly apart from each other in a V shape in the non-installed condition on the center rail, so that the stirrup 47 is present clamped in the mounted state at the recess 44. In the mounted state on the center rail 18, a running surface 58 of the running wheel 45 is raised up from the upper horizontal segment 23 in the direction of the sliding element rail 19 (FIGS. 11, 12).

At a front end segment 59 the sliding element rail 19 has an elevation 60 at the bottom side 19*c* which is raised up from the bottom side 19*c*. The elevation 60 comprises a lengthy up ramp 62 and a relatively short down ramp 63 as compared to the up ramp 62. Advantageously, a gradient of the up ramp 62 is less than a gradient of the down ramp 63.

Figure 12:
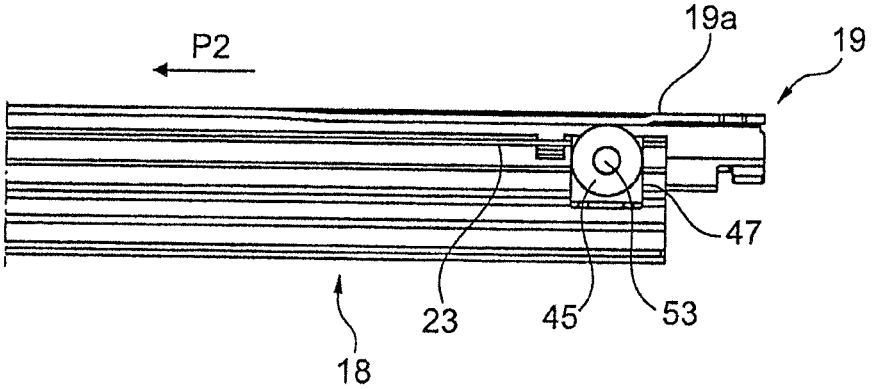
FIG. 12 is a side cross-sectional view through a sliding element rail and a body rail per FIG. 11, representing the sliding element rail in a further, firmly closed position relative to the body rail.

During a closing movement of the sliding element rail 19 in the closing direction P2 relative to the center rail 18, the running wheel 45 with the running surface 58 upon reaching the up ramp 62 rolls along the elevation 60 and thereby braces the sliding element rail 19 against the center rail 18 (FIG. 12). The gradient of the up ramp 62 here is configured such that the kinetic energy of the sliding element guided with the full extension 16 in the closing movement is sufficient to provide the energy needed to travel on the ramp 62.

Now, it is conceivable for the full extension 16 to comprise an automatic retractor (not shown), which moves the rails 17-19 of the full extension at the end of a closing movement of the rails in the closing direction P2 into their final closing position. Further, it is conceivable that, in this case, the sliding element rail 19 is braced by the elevation 60 and the running wheel 45 against the center rail at the end of the movement, and the friction is so large that the energy of the automatic retractor is not enough to move the sliding element rail 19 into the final closing position. In order to assist the automatic retractor, the elevation 60 advantageously has a down ramp 63, so that kinetic energy is added to the closing movement of the sliding element rail 19 in that the running wheel 45 "rolls down" the ramp 63 and thereby accelerates the sliding element rail 19. In the final closing position of the rail of the full extension, the running surface 58 of the running wheel 45 is advantageously offset in a region 65 in the direction of the end 64 of the sliding element rail 19 and spaced apart from the elevation 60, so that the sliding element rail 19 does not touch the running wheel 45 or a supporting of the sliding element rail 19 by the running wheel 45 is negligible as compared to the supporting by the carriage 21.

LIST OF REFERENCE NUMBERS

1 Furniture
2 Furniture body
3 Drawer
4-5 Side wall
6-9 Rail full extension
10-11 Drawer side wall
12 Front element
13 Rear wall
14 Drawer bottom
15 Hollow chamber frame
15*a* Housing
15*b* Internal structure
16 Full extension
17 Body rail
18 Center rail
19 Sliding element rail
19*a* Top side
19*b* Hook element
19*c* Bottom side
20 Carriage
20*a*-20*b* Running cage
21 Carriage
21*a*-21*b* Running cage
22 Movement mechanism
23-24 Horizontal wall section
25-28 Side wall section
29-30 Center wall section
31 Rail body
32 Pin
33-34 Fastening element
35-36 End stop
37-38 Bearing body
39-40 Connection element
41 End segment
42-43 Running surface
44 Recess
45 Running wheel
46 End
47 Stirrup
48 Cavity
49-50 Side wall
51-52 Holding member
53 Bearing shaft
54-55 Narrow side
56-57 Ends
58 Running surface
59 End segment
60 Elevation
61 End stop
62 Up ramp
63 Down ramp
64 End
65 Region

The invention claimed is:

1. A guidance system comprising a guide rail, the guide rail defining at least a longitudinal axis, and a sliding element rail, wherein the guidance system is designed to movably connect a linearly movable sliding element to a body, wherein a carriage can be arranged between the guide rail and the sliding element rail so that the sliding element rail in a mounted condition of the guidance system is movable relative to the guide rail, wherein the guide rail comprises a running surface on at least one of a top side or a bottom side, wherein a movement element of the carriage is movably guided on the running surface in the mounted condition of the guidance system, wherein the top side of the guide rail is provided opposite to and spaced apart from the bottom side of the guide rail, wherein the guide rail has a recess on the at least one of the top side or the bottom side in an end segment of the guide rail and extending along the longitudinal axis, through which a bearing body protrudes, and attachment means are provided to mount the bearing body thereto, the attachment means comprising a generally U-shaped stirrup extending into the recess, the stirrup including at least first and second substantially vertical spaced apart walls, an opening defined between upper edges of the first and second space-apart walls, each wall having at least one bent-over portion extending from an upper edge thereof in a direction transverse to the longitudinal axis and bearing against the running surface of the guide rail adjacent the recess.

2. The guidance system according to claim 1, wherein the stirrup further includes a holding member for mounting the bearing body movably on the guide rail.

3. The guidance system according to claim 2, wherein the holding member is designed to mount the bearing body directly on the guide rail.

4. The guidance system according to claim 2, wherein the bearing body is movably mounted on the attachment member.

5. The guidance system according to claim 1, wherein the guidance system is designed as a full extension and further comprises a body rail, wherein in the mounted condition of the guidance system the guide rail is present between the body rail and the sliding element rail, wherein the bearing body is mounted on holding means of the top side of the guide rail in order to brace the guide rail against the body rail in the closed condition of the guidance system.

6. The guidance system according to claim 1, wherein the guidance system is designed such that the bearing body is freely movable on the guide rail in an opened condition of the guidance system.

7. The guidance system according to claim 1, wherein the guide rail comprises a cavity, wherein the cavity extends along the longitudinal axis, and the at least one of the top side or the bottom side of the guide rail form boundary surfaces of the cavity.

8. The guidance system according to claim 1, wherein the attachment member is configured such that the bearing body can be at least one of clipped or clamped on the attachment member.

9. The guidance system according to claim 1, wherein the sliding element rail comprises a running surface on one bottom side, while an elevation is present on one segment of the bottom side of the sliding element rail, on which the bearing body travels in a movement of the guide rail in the closing direction, so that the sliding element rail is braced by the bearing body against the guide rail.

10. The guidance system according to claim 9, wherein the elevation is provided rising on the sliding element rail.

11. The guidance system according to claim 9, wherein the elevation comprises an up ramp on the bottom side of the sliding element rail, looking in a movement direction of the sliding element rail, and wherein the elevation comprises a down ramp on the bottom side of the sliding element rail, looking in a movement direction of the sliding element rail, wherein the bearing body can roll along at least one of the up ramp or the down ramp in at least one of an opening or a closing movement of the guide rails.

12. The guidance system according to claim 1, wherein the elevation on the sliding element rail is present in a middle region of the bottom side of the sliding element rail, looking transversely to a longitudinal extension of the sliding element rail.

13. The guidance system according to claim 1, wherein at least one of the recess or the bearing body are provided on the guide rail or the elevation is provided on the sliding element rail such that the sliding element rail is braced by the bearing body against the guide rail for a movement path of around 50 mm in at least one of an opening or a closing movement.

14. A piece of furniture or household appliance with a guidance system according to claim 1.

15. A guidance system comprising:

a guide rail defining a longitudinal axis and a sliding element rail, wherein the guidance system is designed to movably connect a linearly movable sliding element to a body, wherein a carriage can be arranged between the guide rail and the sliding element rail so that the sliding element rail in a mounted condition of the guidance system is movable relative to the guide rail, wherein the guide rail comprises a running surface on each of a top side and a bottom side, wherein a movement element of the carriage is movably guided on the running surface of the top side in a mounted condition of the guidance system, wherein the top side of the guide rail is provided opposite to and spaced apart from the bottom side of the guide rail, wherein the guide rail has a recess on the top side in an end segment of the guide rail, through which a bearing body protrudes, wherein attachment means are provided proximate the recesses, the attachment means comprising a generally U-shaped structure extending into the recess, the structure having at least first and second substantially vertical spaced apart walls, an opening defined between upper edges of the first and second spaced apart walls, each wall having at least one bent-over portion extending from an upper edge thereof in a direction transverse to the longitudinal axis and bearing against the running surface of the guide rail surface of the guiderail adjacent the recess in order to mount the bearing body so that, in a closed condition of the guidance system, the sliding element rail is braced against the guide rail, and wherein a cavity extends along the longitudinal axis, and the top side and the bottom side of the guide rail form boundary surfaces of the cavity.

* * * * *